US010622747B2

(12) United States Patent
Miyamura et al.

(10) Patent No.: US 10,622,747 B2
(45) Date of Patent: Apr. 14, 2020

(54) CONNECTOR

(71) Applicants: AutoNetworks Technologies, Ltd., Yokkaichi-shi, Mie (JP); Sumitomo Wiring Systems, Ltd., Yokkaichi-shi, Mie (JP); SUMITOMO ELECTRIC INDUSTRIES, LTD., Osaka-shi, Osaka (JP); Toyota Jidosha Kabushiki Kaisha, Toyota-shi, Aichi (JP)

(72) Inventors: Tetsuya Miyamura, Yokkaichi (JP); Masaaki Tabata, Yokkaichi (JP); Yasuo Omori, Yokkaichi (JP); Hajime Matsui, Yokkaichi (JP); Hiroshi Kobayashi, Okazaki (JP); Motoya Hara, Nisshin (JP); Ryutaro Yamazaki, Toyota (JP)

(73) Assignees: AUTONETWORKS TECHNOLOGIES, LTD. (JP); SUMITOMO WIRING SYSTEMS, LTD. (JP); SUMITOMO ELECTRIC INDUSTRIES, LTD. (JP); TOYOTA JIDOSHA KABUSHIKI KAISHA (JP)

( * ) Notice: Subject to any disclaimer, the term of this patent is extended or adjusted under 35 U.S.C. 154(b) by 0 days.

(21) Appl. No.: 16/339,135

(22) PCT Filed: Sep. 20, 2017

(86) PCT No.: PCT/JP2017/033973

§ 371 (c)(1),
(2) Date: Apr. 3, 2019

(87) PCT Pub. No.: WO2018/070196

PCT Pub. Date: Apr. 19, 2018

(65) Prior Publication Data

US 2020/0044379 A1 Feb. 6, 2020

(30) Foreign Application Priority Data

Oct. 11, 2016 (JP) ..... 2016-199675

(51) Int. Cl.
*H01R 13/436* (2006.01)
*H01R 13/641* (2006.01)
(Continued)

(52) U.S. Cl.
CPC ..... *H01R 13/4368* (2013.01); *H01R 13/428* (2013.01); *H01R 13/516* (2013.01);
(Continued)

(58) Field of Classification Search
CPC ..... H01R 13/4365; H01R 13/4362; H01R 13/4368; H01R 13/641; H01R 13/639;
(Continued)

(56) References Cited

U.S. PATENT DOCUMENTS 5,183,418 A * 2/1993 Yannanashi ..... H01R 13/4368 439/595
5,186,662 A * 2/1993 Yuasa ..... H01R 13/4368 439/595
(Continued)

FOREIGN PATENT DOCUMENTS

JP 2003-203711 7/2003
JP 2004-55470 2/2004
(Continued)

OTHER PUBLICATIONS

International Search Report.

*Primary Examiner* — Gary F Paumen
(74) *Attorney, Agent, or Firm* — Gerald E. Hespos; Michael J. Porco; Matthew T. Hespos

(57) ABSTRACT

A connector includes a housing (10) having a terminal accommodation chamber (11) formed therein, and a first
(Continued)

terminal fitting (12) can be inserted into the terminal accommodation chamber (11). A retainer (20) can be assembled to the housing (10) at a temporary locking position and at a final locking position, and a terminal holding member (30) can be assembled to the housing (10). A second terminal fitting (40) is attached to the terminal holding member (30). Interference parts (24, 26) are formed in the retainer (20) and the terminal holding member (30), respectively. The interference parts do not interfere with each other when the retainer (20) is in the final locking position. However, the interference parts interfere with each other to prevent the terminal holding member (30) from being assembled to the housing (10) when the retainer (20) is in the temporary locking position.

8 Claims, 11 Drawing Sheets

(51) Int. Cl.
*H01R 13/639* (2006.01)
*H01R 13/516* (2006.01)
*H01R 13/631* (2006.01)
*H01R 13/428* (2006.01)

(52) U.S. Cl.
CPC ..... *H01R 13/631* (2013.01); *H01R 13/639* (2013.01); *H01R 13/641* (2013.01)

(58) Field of Classification Search
CPC ... H01R 13/516; H01R 13/631; H01R 13/428
USPC ..... 439/595, 752
See application file for complete search history.

(56) References Cited

U.S. PATENT DOCUMENTS

| | | | | | |
|---|---|---|---|---|---|
| 5,224,876 | A * | 7/1993 | Ito | H01R 13/4367 | 439/595 |
| 5,252,096 | A * | 10/1993 | Okada | H01R 13/4362 | 439/752 |
| 5,439,397 | A * | 8/1995 | Yannanashi | H01R 13/4368 | 439/752 |
| 5,607,327 | A * | 3/1997 | Tsuji | H01R 13/4365 | 439/595 |
| 5,609,503 | A * | 3/1997 | Tsuji | H01R 13/4362 | 439/733.1 |
| 5,647,754 | A * | 7/1997 | Kohno | H01R 13/7032 | 439/188 |
| 5,755,600 | A * | 5/1998 | Yoshida | H01R 13/4362 | 439/752 |
| 5,848,919 | A * | 12/1998 | Nagano | H01R 13/4362 | 439/752 |
| 8,083,543 | B2 * | 12/2011 | Omori | H01R 31/08 | 439/511 |
| 8,968,038 | B2 * | 3/2015 | Kida | H01R 12/7023 | 439/374 |
| 9,728,854 | B2 * | 8/2017 | Kim | H01Q 1/243 | |
| 10,454,200 | B2 * | 10/2019 | Uenosono | H01R 13/4362 | |
| 10,476,193 | B2 * | 11/2019 | Miyamura | H01R 13/514 | |
| 2005/0095876 | A1 | 5/2005 | Nishide | | |
| 2005/0095910 | A1 | 5/2005 | Nishide | | |
| 2005/0095921 | A1 | 5/2005 | Nishide | | |
| 2008/0242158 | A1 | 10/2008 | Matsushita | | |
| 2018/0309225 | A1 * | 10/2018 | Kutsuna | H01R 13/4362 | |
| 2018/0342827 | A1 * | 11/2018 | Uenosono | H01R 13/436 | |

FOREIGN PATENT DOCUMENTS

| | | |
|---|---|---|
| JP | 2005-135685 | 5/2005 |
| JP | 2008-270152 | 11/2008 |

* cited by examiner

CONNECTOR

BACKGROUND

Field of the Invention

The present invention relates to a connector.

Related Art

JP 2004-055470 A discloses a connector used in an in-vehicle LAN (local area network). A wire harness for an in-vehicle LAN is formed by bundling a communication wire with countermeasures against noise, such as a twisted pair wire, and a power supply wire for supplying power to equipment such as a car navigation system. Terminal fittings secured to these electric wires are inserted into one housing, and the inserted terminal fittings are held in a retained state being prevented from coming off by a locking action of a retainer assembled to the housing.

In a state before insertion of the terminal fittings into the housing, the retainer is kept at a temporary locking position with respect to the housing. The retainer in the temporary locking position does not interfere with the terminal fittings during the insertion process. After all the terminal fittings have been inserted into the housing, the retainer in the temporary locking position is pushed into the housing. As a result, the retainer moves to a final locking position where the retainer retains the terminal fittings.

In a case where an operator finishes the assembling operation without pushing the retainer from the temporary locking position to the final locking position, it is possible to detect whether or not the retainer has moved to the final locking position by a continuity test after assembly. However, if the retainer is returned to the temporary locking position after the continuity test for some reason, there is a concern that the connector may be delivered to a customer in a state where the retainer is not pushed to the final locking position.

The present invention has been accomplished based on the above circumstances, and is intended to prevent overlooking of the state where the retainer is in the temporary locking position.

SUMMARY

The first aspect of the present invention includes a housing having a terminal accommodation chamber formed therein and a first terminal fitting that can be inserted into the terminal accommodation chamber. A retainer can be assembled to the housing at a temporary locking position and at a final locking position. The retainer is configured to allow the first terminal fitting to be inserted into the terminal accommodation chamber when the retainer is in the temporary locking position. However, the retainer is configured to retain the first terminal fitting inserted in the terminal accommodation chamber when the retainer is in the final locking position. A terminal holding member can be assembled to the housing, and a second terminal fitting is attached to the terminal holding member. Interference parts are formed in the retainer and the terminal holding member, respectively. The interference parts do not interfere with each other when the retainer is in the final locking position. However, the interference parts interfere with each other to prevent the terminal holding member from being assembled to the housing when the retainer is in the temporary locking position.

In a state where the retainer is attached in the final locking position, the terminal holding member can be assembled to the housing. In a state where the retainer is in the temporary locking position, the interference part of the retainer and the interference part of the terminal holding member interfere with each other, so that the terminal holding member cannot be assembled to the housing. Thus, it is possible to prevent overlooking of the state where the retainer is in the temporary locking position.

The outer surface of the retainer may function as the interference part. According to this configuration, it is unnecessary to form the interference part of the retainer into a special shape, with the result that the cost for the die can be reduced.

An accommodation recess may be formed in the housing and may be capable of accommodating the terminal holding member. According to this configuration, the terminal holding member does not protrude from the outer surface of the housing in a state where the terminal holding member is assembled to the housing. Thus, the shape of the connector can be simplified.

A plate-shaped support part may be formed in the housing and continued to the accommodation recess. Additionally, a locking part formed in the plate-shaped support may hold the terminal holding member in a detachment restricted state. According to this configuration, when the terminal holding member is to be accommodated in the accommodation recess, the plate-shaped support is deformed elastically and thereby the locking part can be locked to the terminal holding member. Thus, it is not necessary to form elastically deformable portions in the locking part and the terminal holding member, with the result that the shapes of the locking part and the terminal holding member can be simplified.

The retainer and the locking part may be spaced apart from each other in a direction intersecting an assembling direction of the terminal holding member to the housing, and the accommodation recess may be formed with a guide for stabilizing the posture of the terminal holding member by bringing the terminal holding member into sliding contact therewith. The guide may be parallel with the assembling direction of the terminal holding member to the housing. According to this configuration, since the posture of the terminal holding member is stabilized when the terminal holding member is assembled to the housing, it is possible to prevent improper assembly such that the terminal holding member is locked to the locking part while assuming an oblique posture due to interference with the retainer in the temporary locking position.

DETAILED DESCRIPTION

Figure 1:
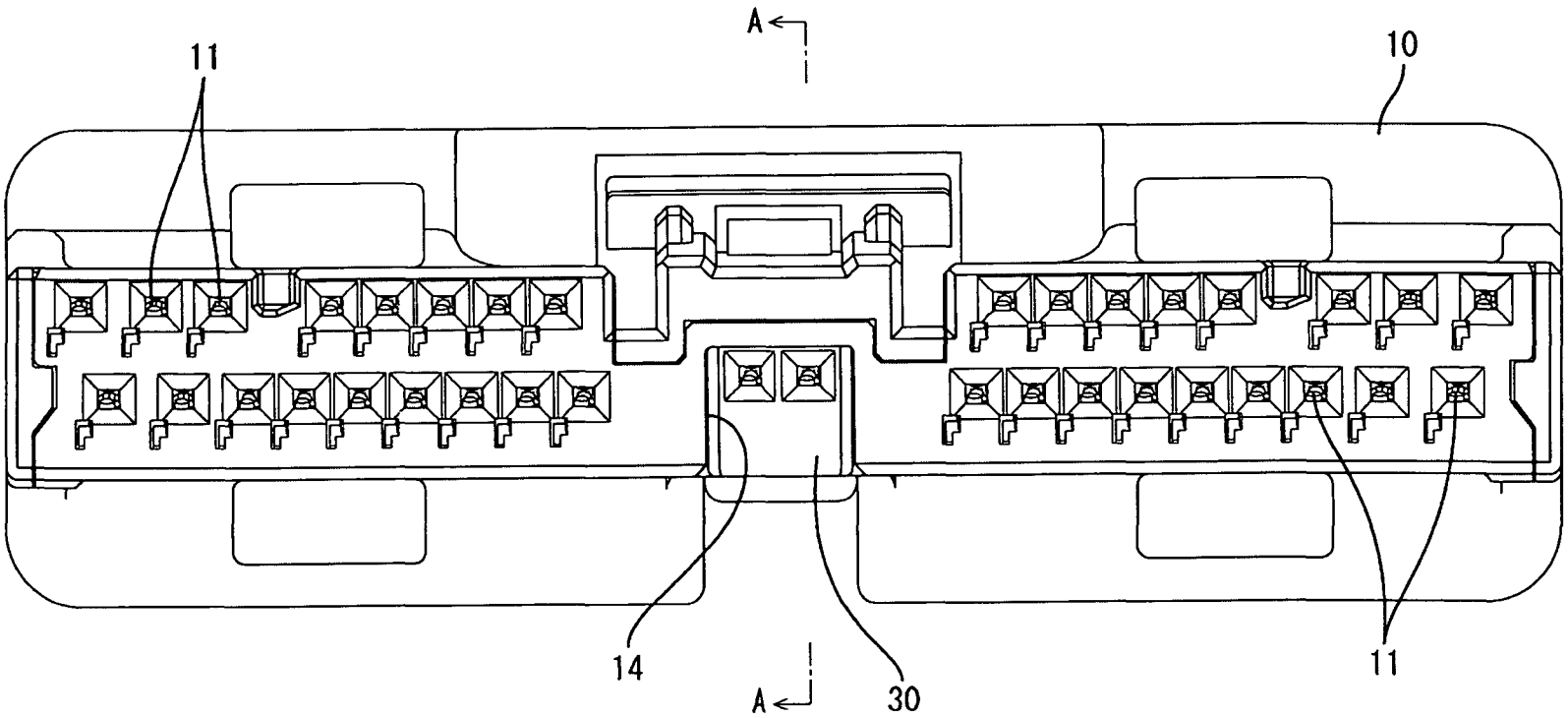
FIG. 1 is a front view showing a state where a terminal holding member is assembled to a housing in a first embodiment.
Figure 2:
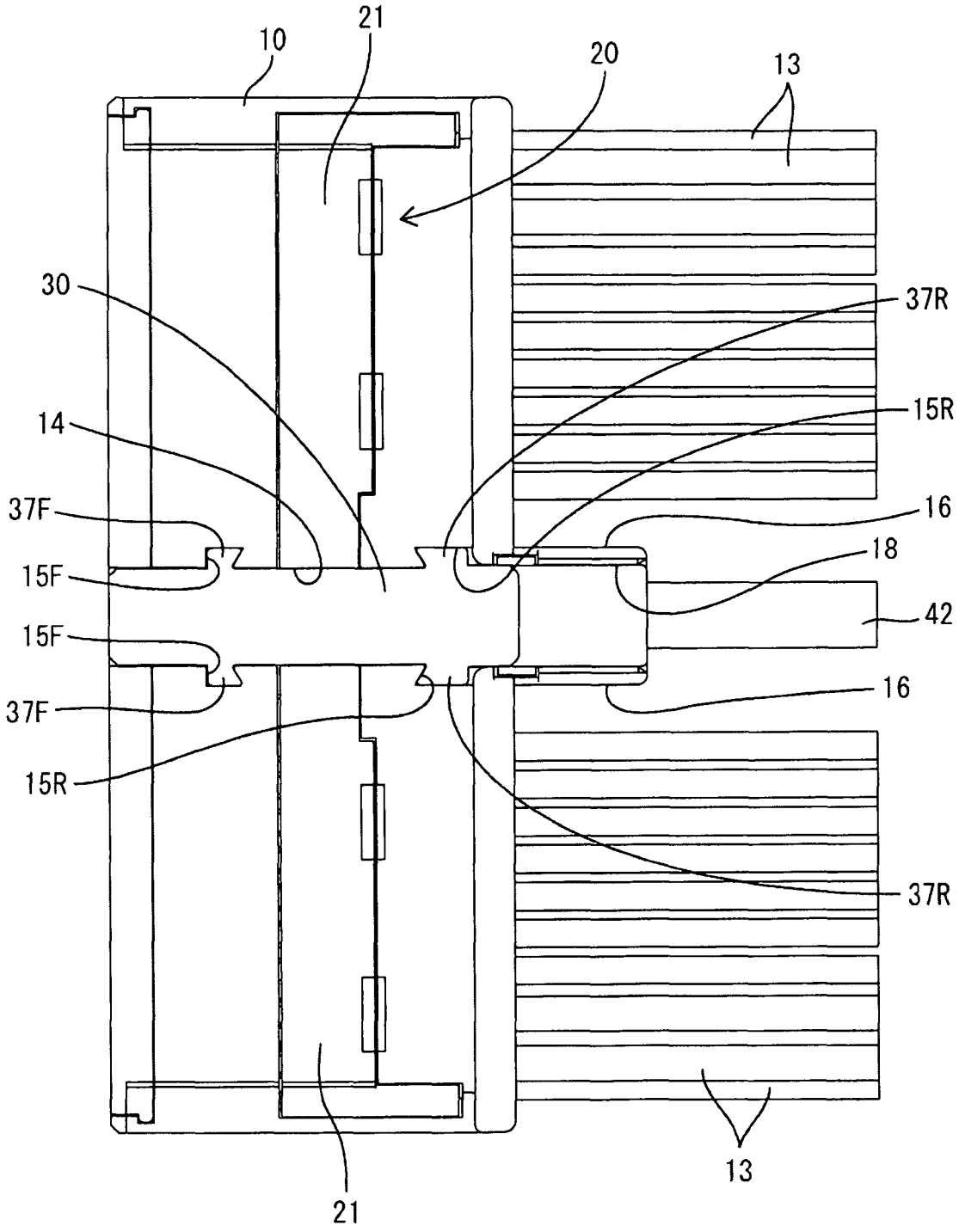
FIG. 2 is a bottom view showing the state where the terminal holding member is assembled to the housing.
Figure 3:
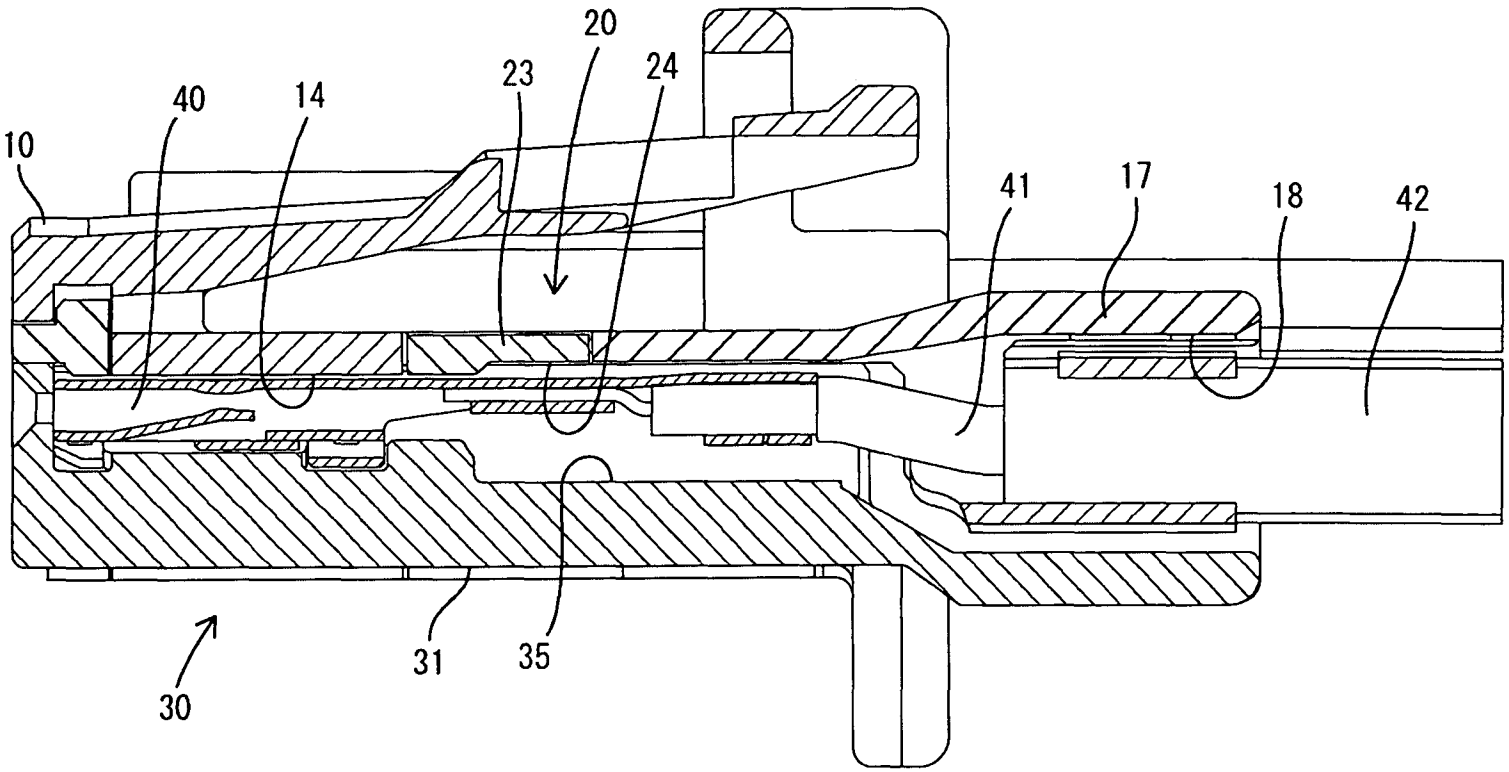
FIG. 3 is a cross-sectional view taken along line A-A of FIG. 1.
Figure 4:
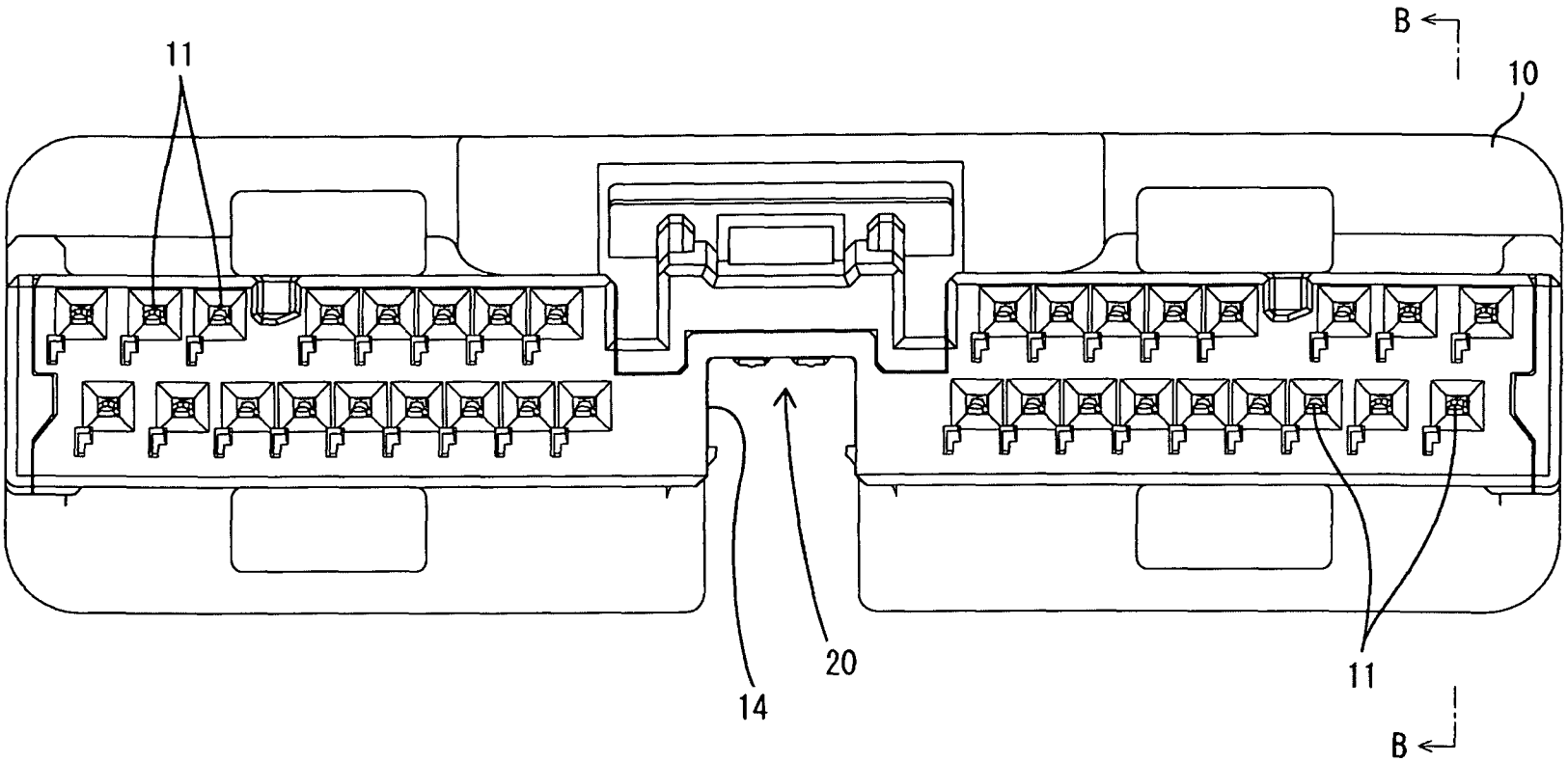
FIG. 4 is a front view showing a state where the retainer is in a final locking position in the housing in which the terminal holding member has not been assembled yet.
Figure 5:
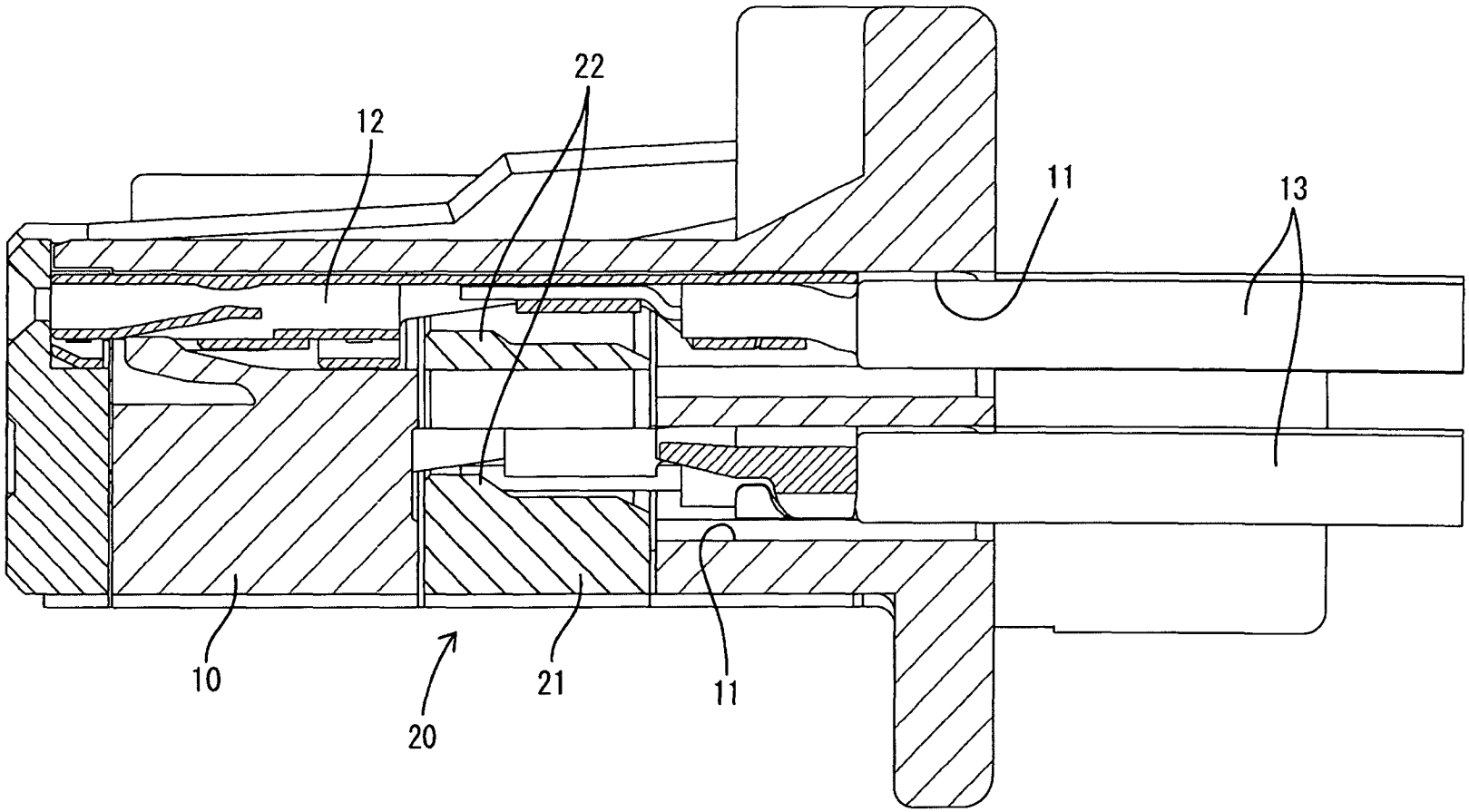
FIG. 5 is a cross-sectional view taken along line B-B of FIG. 4.

An embodiment of the present invention will be described with reference to FIGS. 1 to 11. In the following description, with regard to the longitudinal direction, the left side in FIGS. 2, 3, 5, 7, and 8 is defined as the front side. With regard to the vertical direction, the orientations appearing in FIGS. 1, and 3 to 8 are defined as the upper and lower sides as they are.

A connector of the present embodiment includes a housing 10 made of synthetic resin, a plurality of first terminal fittings 12, a retainer 20 made of synthetic resin, a terminal holding member 30 made of synthetic resin, and a pair of second terminal fittings 40. The housing 10 has a flattened shape having a lateral dimension (width dimension) larger than a vertical dimension. Terminal accommodation chambers 11 are formed inside the housing 10. The first terminal fittings 12 are inserted into the respective terminal accommodation chambers 11 from the rear side of the housing 10. The inserted first terminal fittings 12 are each retained so as not to come off by locking of a lance formed in each of the terminal accommodation chambers 11. Each first terminal fitting 12 is connected to a first electric wire 13 without countermeasures against noise.

The central portion in the width direction of the housing 10 is formed with an accommodation recess 14 by recessing the lower surface (outer surface) of the housing 10. The accommodation recess 14 is elongated in the longitudinal direction and is opened to both front and rear surfaces of the housing 10. Two symmetrical front guide grooves 15F (guide part recited in the claims) are formed on both left and right inner side surfaces of the accommodation recess part 14. The front guide grooves 15F extend in the vertical direction (a direction parallel to the assembling direction of the terminal holding member 30 to the housing 10). In both left and right inner side surfaces of the accommodating recess part 14, a pair of symmetric rear guide grooves 15R (guide part recited in claims) are formed in the region rearward from the front guide grooves 15F. The front guide grooves 15F and the rear guide grooves 15R extend in the vertical direction and are opened to the lower surface of the housing 10.

At the rear end portion of the housing 10, there are formed a pair of symmetrical plate-shaped support parts 16 which protrude as if both left and right inner side surfaces of the accommodation recess part 14 extend rearward. Also at the rear end portion of the housing 10, there is formed a top plate 17 that protrudes rearward to connect the upper end edges of the plate-shaped supports 16. The left and right plate-shaped support parts 16 are elastically deformable so as to expand outward in the lateral direction.

A space surrounded by the plate-shaped supports 16 and the top plate part 17 serves as a support recess part 18 (locking part recited in the claims) communicating with the rear end of the accommodation recess 14. The inner side surfaces of both left and right plate-shaped supports 16 (support recess part 18) are formed with two symmetrical locking recesses 19, respectively. The locking recesses 19 each have a locking surface facing upward (in the same direction as the assembling direction of the terminal holding member 30 to the housing 10). The locking recess parts 19 are located rearward from the front guide grooves 15F and the rear guide grooves 15R.

The retainer 20 has an elongated shape in the lateral direction. The retainer 20 is a single component including of left and right retaining function parts 21 and a horizontal plate-shaped connecting part 23 which connects the upper end edges of both left and right retaining function parts 21 with each other. The retaining function parts 21 are formed with of retaining protrusions 22 that are each locked to the first terminal fitting 12 inserted into the terminal accommodation chamber 11 so that the first terminal fitting 12 can be prevented from coming off. The plate thickness direction of the plate-shaped connecting part 23 is directed in the vertical direction. The outer surface (lower surface) of the plate-shaped connecting part 23 functions as an interference surface 24 (interference part recited in the claims).

Figure 6:
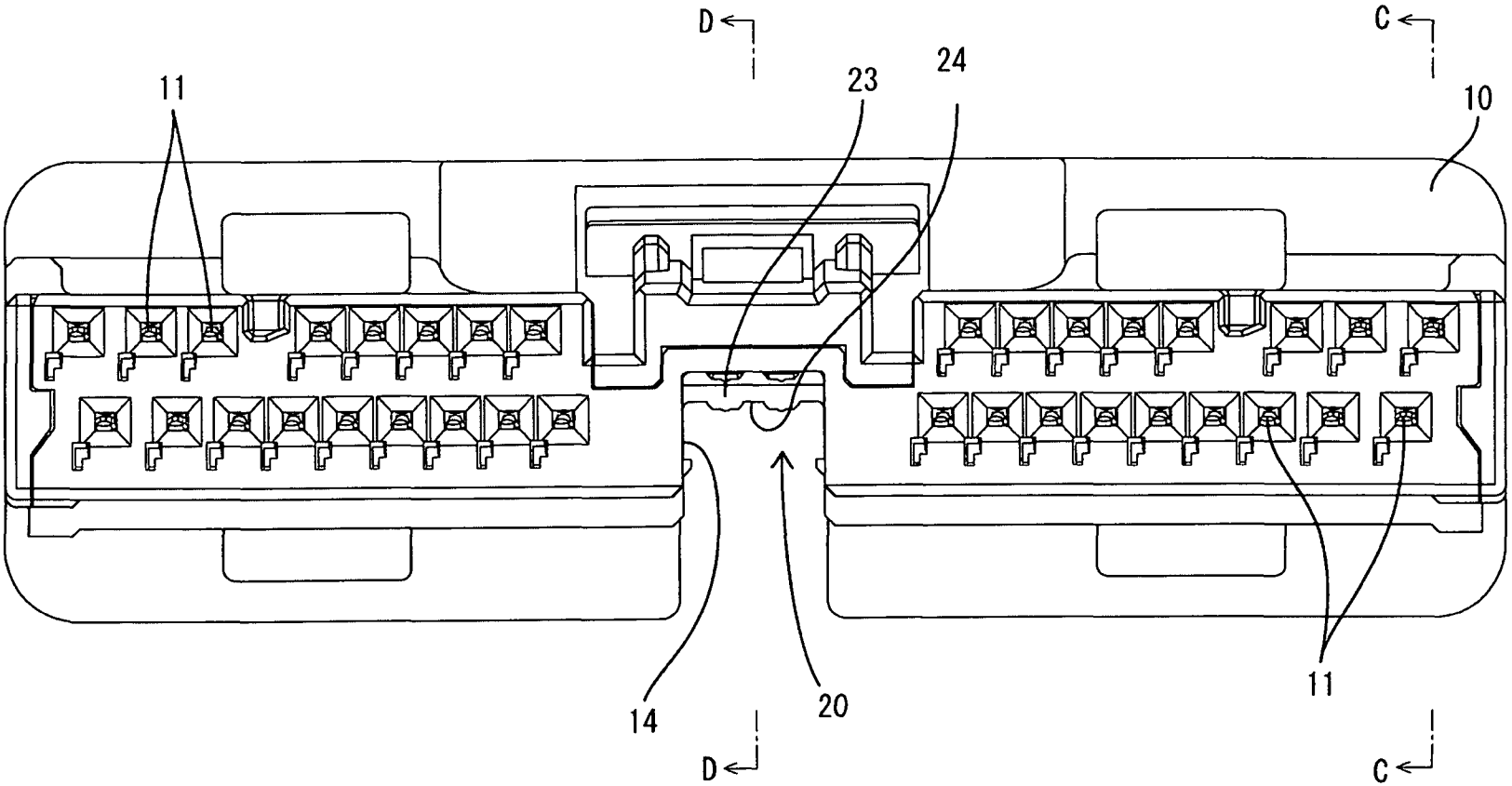
FIG. 6 is a front view showing a state where the retainer is in a temporary locking position in the housing in which the terminal holding member has not been assembled yet.
Figure 7:
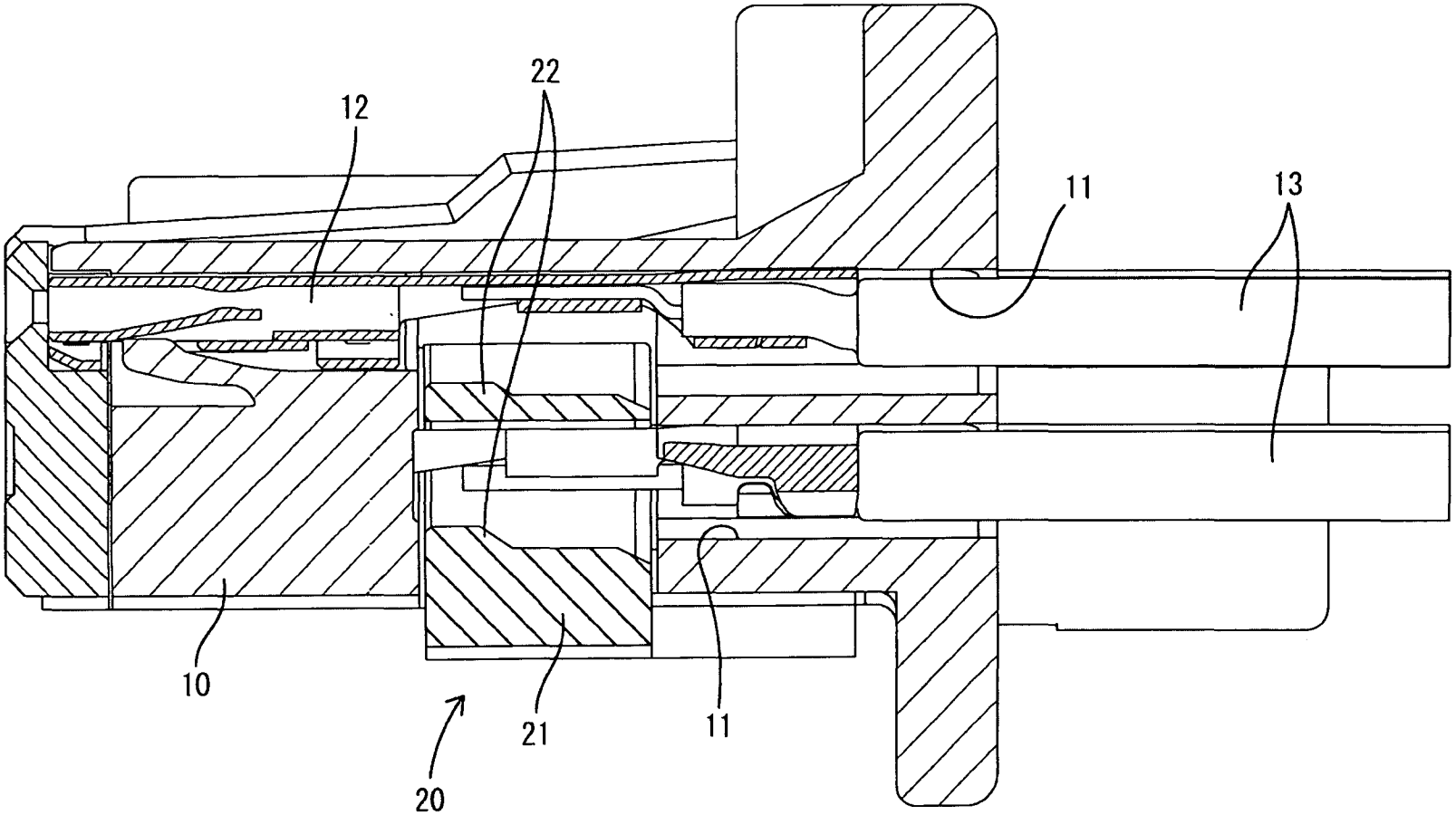
FIG. 7 is a cross-sectional view taken along line C-C of FIG. 6.
Figure 8:
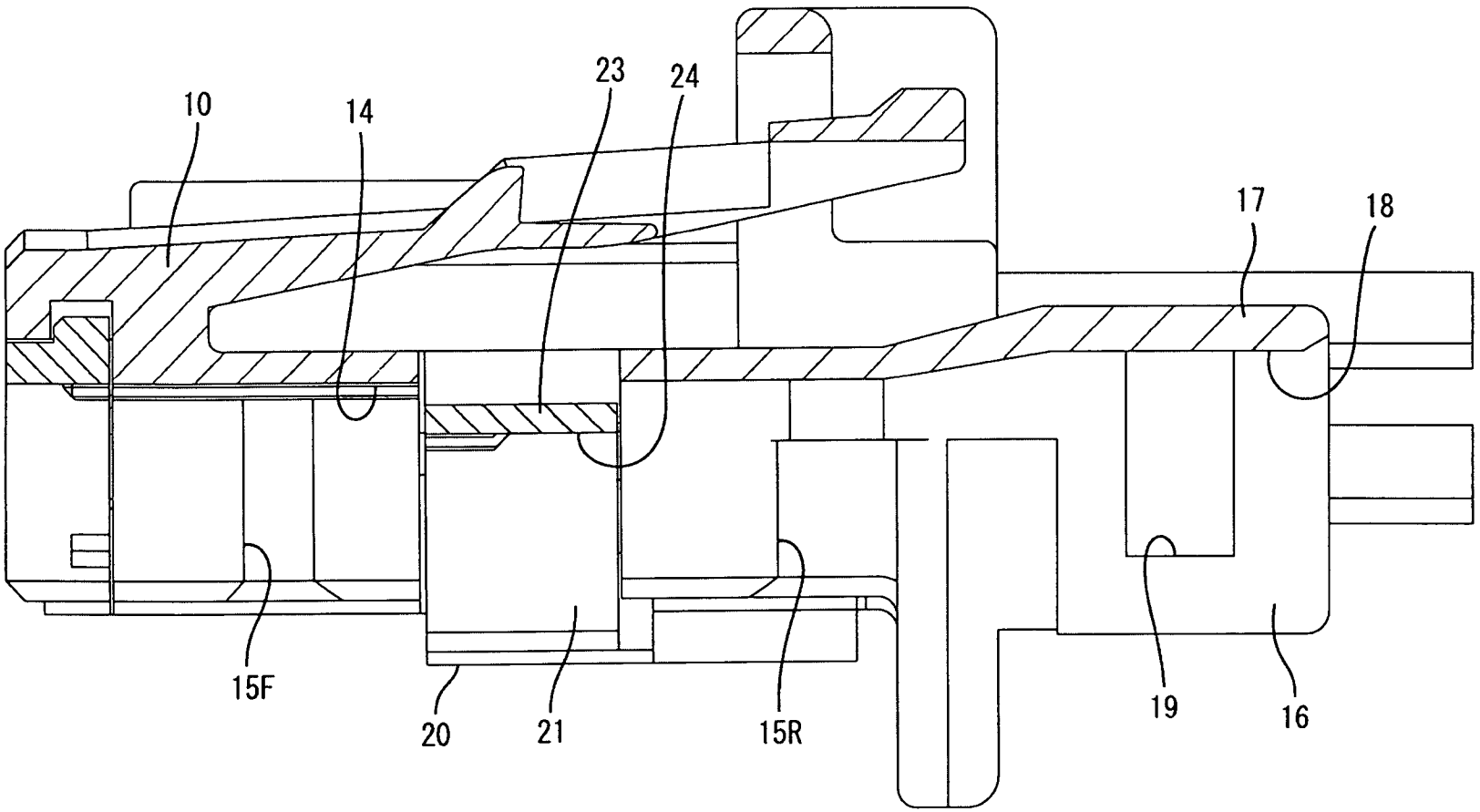
FIG. 8 is a cross-sectional view taken along the line D-D of FIG. 6.
Figure 9:
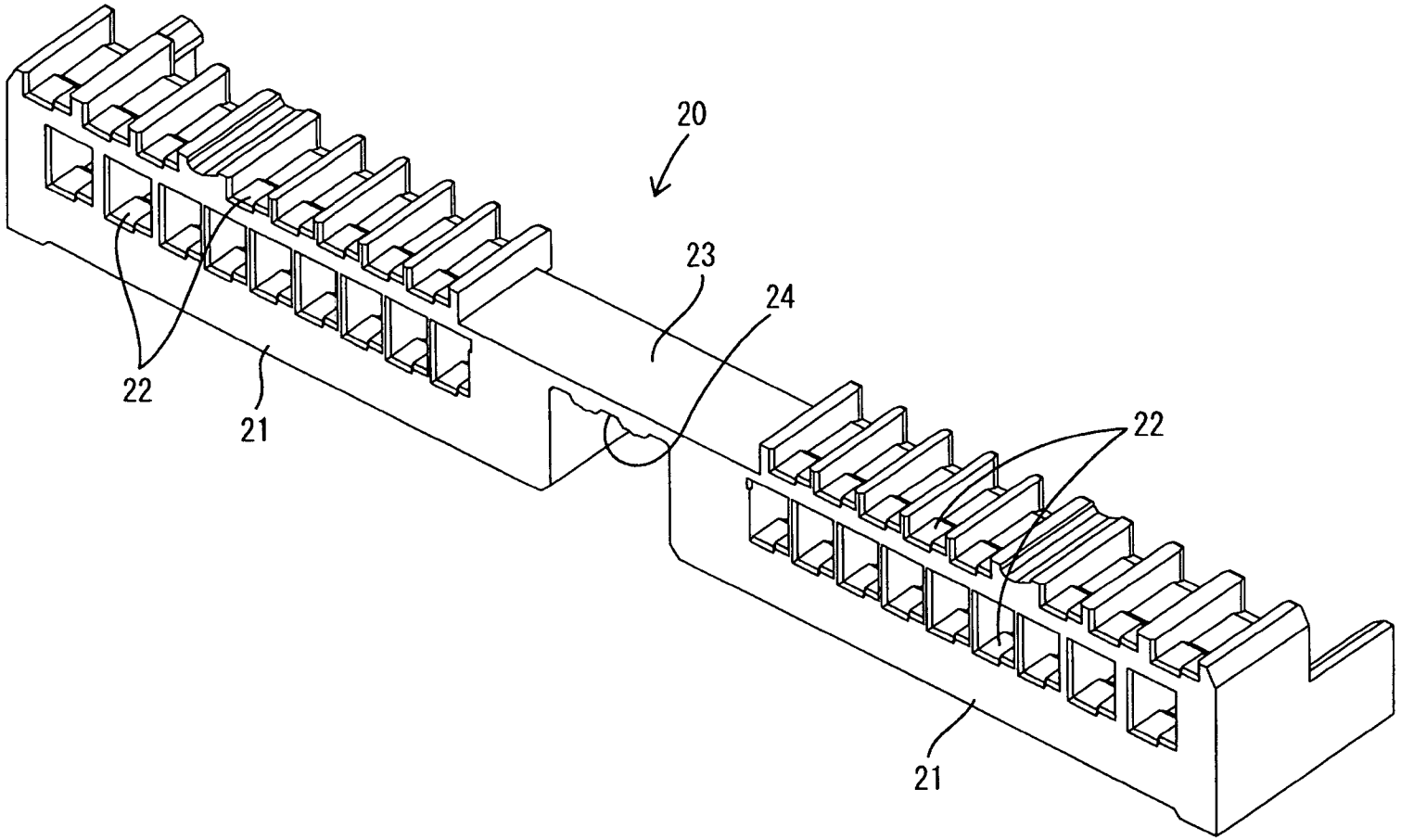
FIG. 9 is a perspective view of the retainer.
Figure 10:
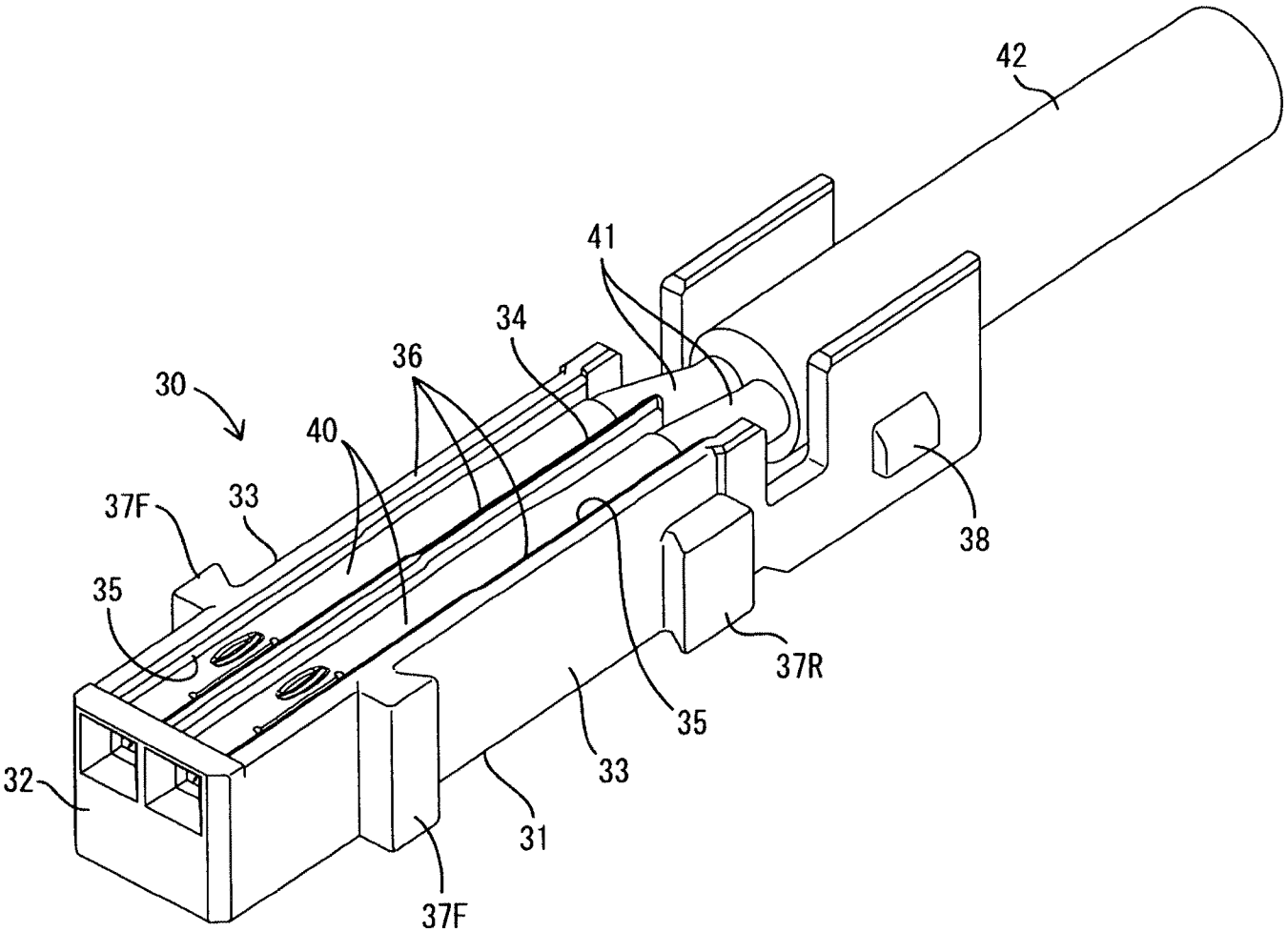
FIG. 10 is a perspective view of the terminal holding member in a state where second terminal fittings are attached thereto.
Figure 11:
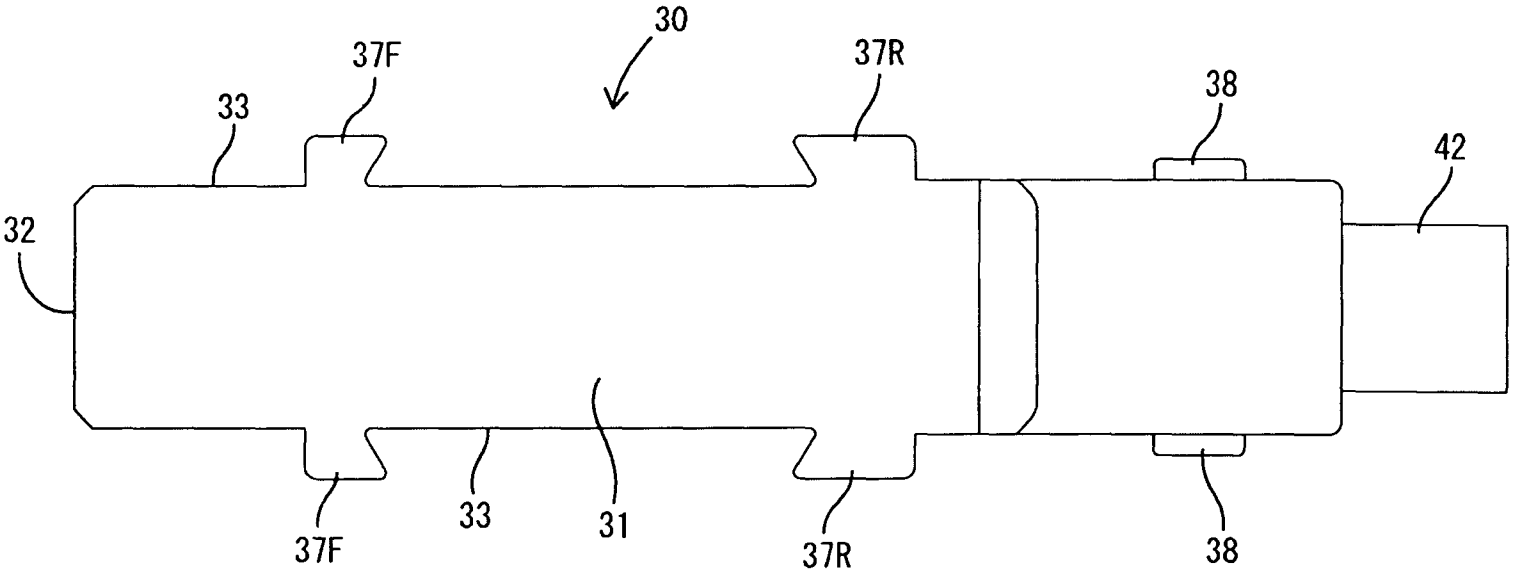
FIG. 11 is a bottom view of the terminal holding member in the state where the second terminal fittings are attached thereto.

The retainer 20 is configured to be assembled to the housing 10 at a final locking position (see FIGS. 3 to 5) and at a temporary locking position slightly lower than the final locking position (see FIGS. 6 to 8). The retainer 20 is attached substantially in the center of the housing 10 in the longitudinal direction and at a position between the front guide grooves 15F and the rear guide grooves 15R. In a state where the retainer 20 is attached to the housing 10, the inner side surfaces of both left and right retaining function parts 21 and the lower surface of the plate-shaped connecting part 23 constitute a part of the inner surface of the accommodation recess part 14.

In a state where the retainer 20 is in the final locking position, the whole of the retaining function parts 21 are accommodated inside the housing 10, and the retaining protrusions 22 are arranged at a position where each retaining protrusion 22 retains the first terminal fitting 12. Also in a state where the retainer 20 is in the final locking position, almost the whole of the plate-shaped connecting part 23 is located just above the accommodation recess part 14 whole being accommodated in the housing 10, and the interference surface 24 faces downward in the space of the accommodation recess part 14.

In a state where the retainer 20 is in the temporary locking position, almost the whole of the retaining function parts 21 except for the lower end portions thereof are accommodated in the housing 10, and the retaining protrusions 22 are each retracted at a position where the retaining protrusion 22 does not retain the first terminal fitting 12 (that is, at a position allowing insertion/removal of the first terminal fitting 12 into/from the terminal accommodation chamber 11). Similarly, in a state where the retainer 20 is in the temporary locking position, almost the whole of the plate-shaped connecting part 23 advances into the accommodation recess part 14.

The terminal holding member 30 has an elongated shape in the longitudinal direction. The terminal holding member 30 includes a bottom wall 31 extending in the longitudinal direction, a front wall 32 standing up from the front end of the bottom wall 31, a pair of outer side walls 33 standing up from both left and right side edges of the bottom wall 31, and a partition wall 34 standing up from the center in the width direction of the bottom wall 31.

The terminal holding member 30 is formed with two symmetrical terminal accommodation grooves 35 defined by the bottom wall 31, the left and right outer side walls 33, and the partition wall 34. The second terminal fittings 40 are accommodated in the respective terminal accommodation grooves 35, and are held in a detachment restricted state. The two second terminal fittings 40 are connected to the front end portions of two second electric wires 41. These two second electric wires 41 constitute a twisted pair wire (not shown) which is a conducting path with countermeasures against noise.

Both left and right outer side walls 33 are formed from the front end to the rear end of the terminal holding member 30 (bottom wall 31), but the range of formation of the partition wall 34 covers from the front end of the terminal holding member 30 (bottom wall 31) to a position frontward from the rear end. A front end portion of a sheath 42, which collectively surrounds the two second electric wires 41 (twisted pair wire), is accommodated in a region rearward from the partition wall 34 in the terminal holding member 30.

Both left and right terminal accommodation grooves 35 are formed to be opened to the upper surface and rear surface of the terminal holding member 30. The opening edge portions on the upper surface side of the terminal accommodation groove 35 (the upper end edge portions of both left and right outer side walls 33 and the upper end edge of the partition wall 34) function as interference edges 36 (interference parts recited in the claims). Two symmetrical front guide ribs 37F and two symmetrical rear guide ribs 37R arranged rearward from the front guide ribs 37F are formed on the outer surfaces of both left and right outer side walls 33. The guide ribs 37F, 37R extend in a vertical direction, that is, a direction parallel to the assembling direction of the terminal holding member 30 to the housing 10. The assembling direction of the terminal holding member 30 to the housing 10 is the same as the moving direction when the retainer 20 is displaced from the temporary locking position to the final locking position.

At the rear end portions of both left and right outer side walls 33, there are formed a pair of locking protrusions 38 protruding from the outer surfaces thereof. The locking protrusions 38 are located at the same position as the front end portion of the sheath 42 in the longitudinal direction, and are arranged at a position rearward from the guide ribs 37F, 37R. The rear end portion of the terminal holding member 30 where the locking protrusions 38 are formed is configured to be accommodated in the support recess 18 of the housing 10. A region of the terminal holding member 30 where the partition wall 34 is formed is configured to be accommodated in the accommodation recess 14 of the housing 10.

Next, the assembling procedures of the connector will be described. First, the retainer 20 is assembled to the housing 10 in a state where the first terminal fittings 12 and the terminal holding member 30 have not yet been attached thereto, and held in the temporary locking position by a locking means (not shown). Next, the first terminal fittings 12 are inserted into the respective terminal accommodation chambers 11 and primarily locked by lances. When insertion of all the first terminal fittings 12 is completed, the retainer 20 in the temporary locking position is pushed up to the final locking position.

At this time, if there is a first terminal fitting 12 in a half-inserted state, the retaining protrusion 22 interferes with the first terminal fitting 12 in the half-inserted state, so that the retainer 20 cannot be displaced to the final locking position. When all the first terminal fittings 12 are properly inserted, the retainer 20 can be moved to the final locking position. Therefore, the insertion state of the first terminal fittings 12 can be detected based on whether or not the retainer 20 can be moved to the final locking position.

After the retainer 20 has been displaced to the final locking position, the terminal holding member 30 to which the second terminal fittings 40 are attached is assembled to the housing 10. In this assembling, the front guide ribs 37F and the rear guide ribs 37R are respectively fitted into the front guide grooves 15F and the rear guide grooves 15R from the lower side of the housing 10, and along therewith the terminal holding member 30 is accommodated in the accommodation recess 14 and the support recess part 18. At this time, since the posture of the terminal holding member 30 with respect to the housing 10 is stabilized by fitting of the guide ribs 37F, 37R and the guide grooves 15F, 15R, the terminal holding member 30 moves in parallel while keeping a constant posture.

During this assembling, since the locking protrusions 38 are brought in contact with the inner side surfaces of the plate-shaped supports 16, the plate-shaped supports 16 are elastically expanded and deformed outward in the width direction. Then, when the terminal holding member 30 reaches a proper assembling position, the locking protrusions 38 are locked to the locking recesses 19, so that the terminal holding member 30 is held in an assembled state with respect to the housing 10.

Furthermore, in a case where the terminal holding member 30 has been assembled to the housing 10 while the retainer 20 remains in the temporary locking position for some reason, it can be detected that the retainer 20 has not moved to the final locking position. That is, in the process of assembling the terminal holding member 30, the interference edges 36 of the terminal holding member 30 abut against the interference surface 24 of the retainer 20 before the terminal holding member 30 reaches the proper assembling position, so that the assembling operation cannot be advanced any further. In a state where the interference edge portions 36 interfere with the interference surface 24, since the locking protrusions 38 are not locked to the locking recesses 19, the terminal holding member 30 can be detached from the housing 10 when being pulled down. Thus, it can be detected that the retainer 20 is in the temporary locking position.

As described above, the connector of the present embodiment includes the housing 10 having a terminal accommodation chamber 11 formed therein, the first terminal fitting 12 that can be inserted into the terminal accommodation chamber 11, and the retainer 20. The retainer 20 can be assembled to the housing 10 at the temporary locking position and at the final locking position. The retainer 20 allows insertion of the first terminal fittings 12 into the terminal accommodation chamber 11 when being in the temporary locking position and the retainer 20 retains the first terminal fittings 12 inserted into the terminal accommodation chamber 11 when being in the final locking position. The terminal holding member 30 is assembled to the housing 10. The second terminal fitting 40 is attached to the terminal holding member 30.

The interference parts (interference surface 24 and interference edge portion 36) are formed in the retainer 20 and the terminal holding member 30, respectively, so that the interference parts do not interfere with each other when the retainer 20 is in the final locking position, and the interference parts interfere with each other to prevent the assembly of the terminal holding member 30 to the housing 10 when the retainer 20 is in the temporary locking position. According to this configuration, the terminal holding member 30 can be assembled to the housing 10 when the retainer 20 is attached in the final locking position. On the other hand, when the retainer 20 is in the temporary locking position, the interference surface 24 of the retainer 20 and the interference edge 36 of the terminal holding member 30 interfere with each other, so that the terminal holding member 30 cannot be assembled to the housing 10. Thus, it is possible to prevent overlooking of the state where the retainer 20 is in the temporary locking position.

Further, the outer surface (lower surface) of the retainer 20 serves as the interference surface 24 having a function as the interference part. According to this configuration, it is unnecessary to form the interference part (interference surface 24) of the retainer 20 into a special shape, with the result that the cost for the die of the retainer 20 can be reduced. In addition, since the accommodation recess 14 capable of accommodating the terminal holding member 30 is formed in the housing 10, the terminal holding member 30 does not protrude from the outer surface of the housing 10 in a state where the terminal holding member 30 is assembled to the housing 10. Therefore, the shape of the connector can be simplified.

Furthermore, the pair of left and right plate-shaped support parts 16 continued to the accommodation recess 14 are formed in the housing 10, and the locking recesses 19 which hold the terminal holding member 30 in a detachment restricted state are formed on the inner side surfaces of both plate-shaped supports 16. According to this configuration, when the terminal holding member 30 is to be accommodated in the accommodation recess 14, the plate-shaped supports 16 are elastically deformed and thereby the locking recesses 19 can be locked to the terminal holding member 30. Thus, it is not necessary to form an elastically deformable portions in the locking recesses 19 or the terminal holding member 30, the shapes of the locking recesses 19 and the terminal holding member 30 can be simplified.

Furthermore, the retainer 20 and the locking recesses 19 are arranged so as to be spaced apart from each other in the direction intersecting the assembling direction of the terminal holding member 30 to the housing 10. The accommodation recess 14 is formed with guide grooves 15F, 15R for stabilizing the posture of the terminal holding member 30 by fitting the guide ribs 37F, 37R of the terminal holding member 30 therein and bring the terminal holding member 30 in sliding contact therewith, the guides 15F, 15R being in parallel with the assembling direction of the terminal holding member 30 to the housing 10. According to this configuration, since the posture of the terminal holding member 30 is stabilized when the terminal holding member 30 is assembled to the housing 10, it is possible to prevent the occurrence of improper assembly such that the locking protrusions 38 are locked to the locking recesses 19 while the terminal holding member 30 assumes an oblique posture due to interference with the retainer 20 in the temporary locking position.

Other Embodiments

The present invention should not be limited to the embodiment described by the above description and drawings, and the following embodiments are also included in the technical scope of the present invention, for example.

In the above embodiment, the terminal holding member is accommodated in the accommodation recess part formed in the outer surface of the housing, but the terminal holding member may be assembled in a state of protruding from the outer surface of the housing.

In the above embodiment, the outer surface of the retainer has a function as the interference part, but an interference part may be formed inside the retainer.

In the above embodiment, the locking part is formed in the plate-shaped support part which is elastically deformable, but the locking part may be formed at a portion which is hardly elastically deformed. In this case, by forming the locking part into an elastically deformable shape, the locking part and the terminal holding member can be locked with each other.

In the above embodiment, the assembling direction of the terminal holding member to the housing is parallel to the direction of displacement of the retainer from the temporary locking position to the final locking position. However, the assembling direction of the terminal holding member to the housing may intersect the displacement direction of the retainer.

In the above embodiment, the first terminal fitting is connected to the electric wire without countermeasures against noise, but the first terminal fitting may be connected to an electric wire with countermeasures against noise.

In the above embodiment, the second terminal fitting is connected to the electric wire with countermeasures against noise, but the second terminal fitting may be connected to an electric wire without countermeasures against noise.

REFERENCE SIGNS LIST

10 . . . housing
11 . . . terminal accommodation chamber
12 . . . first terminal fitting
14 . . . accommodation recess
15F . . . front guide groove (guide part)
15R . . . rear guide groove (guide part)
16 . . . plate-shaped support
19 . . . locking recess (locking part)
20 . . . retainer
24 . . . interference surface (interference part)
30 . . . terminal holding member
36 . . . interference edge (interference part)
40 . . . second terminal fitting

The invention claimed is:

1. A connector comprising:

a housing having a terminal accommodation chamber formed therein;

a first terminal fitting that can be inserted into the terminal accommodation chamber;

a retainer that can be assembled to the housing at a temporary locking position and at a final locking position, the retainer being configured to allow the first terminal fitting to be inserted into the terminal accommodation chamber when being in the temporary locking position, the retainer being configured to retain the first terminal fitting inserted in the terminal accommodation chamber when being in the final locking position;

a terminal holding member that can be assembled to the housing;

a second terminal fitting attached to the terminal holding member; and interference parts formed in the retainer and the terminal holding member, respectively, the interference parts not interfering with each other when the retainer is in the final locking position, the interference parts interfering with each other to prevent the terminal holding member from being assembled to the housing when the retainer is in the temporary locking position.

2. The connector according to claim 1, wherein the interference parts comprise an outer surface of the retainer.

3. The connector according to claim 1 or 2, further comprising an accommodation recess formed in the housing and configured to accommodate the terminal holding member.

4. The connector according to claim 3, further comprising:

a plate-shaped support formed in the housing and continued to the accommodation recess, and a locking part formed in the plate-shaped support to hold the terminal holding member in a detachment restricted state.

5. The connector according to claim 4, wherein the retainer and the locking part are spaced apart from each other in a direction intersecting an assembling direction of the terminal holding member to the housing, and wherein the accommodation recess is formed with a guide for stabilizing the posture of the terminal holding member by bringing the terminal holding member into sliding contact therewith, the guide part being in parallel with the assembling direction of the terminal holding member to the housing.

6. The connector according to claim 1, further comprising an accommodation recess formed in the housing and configured to accommodate the terminal holding member.

7. The connector according to claim 6, further comprising:

a plate-shaped support formed in the housing and continued to the accommodation recess, and a locking part formed in the plate-shaped support to hold the terminal holding member in a detachment restricted state.

8. The connector according to claim 7, wherein the retainer and the locking part are spaced apart from each other in a direction intersecting an assembling direction of the terminal holding member to the housing, and wherein the accommodation recess is formed with a guide for stabilizing the posture of the terminal holding member by bringing the terminal holding member into sliding contact therewith, the guide part being in parallel with the assembling direction of the terminal holding member to the housing.

* * * * *